United States Patent [19]

Kitahara

[11] 4,265,609

[45] May 5, 1981

[54] METHOD AND APPARATUS FOR MOLDING CONCRETE BLOCK PRODUCTS

[76] Inventor: Yutaka Kitahara, 2329-1 Abe, Ochiaicho, Takahashi-shi, Okayama, Japan

[21] Appl. No.: 968,904

[22] Filed: Dec. 13, 1978

[30] Foreign Application Priority Data

Jul. 19, 1978 [JP] Japan ..... 53-87116
Jul. 19, 1978 [JP] Japan ..... 53-87117

[51] Int. Cl.[3] ..... B30B 9/28

[52] U.S. Cl. ..... 425/260; 425/352; 425/424; 425/435; 425/452

[58] Field of Search ..... 425/260, 424, 352, 435, 425/452

[56] References Cited

U.S. PATENT DOCUMENTS

| | | | |
|---|---|---|---|
| 1,987,721 | 1/1935 | Straub | 425/424 |
| 3,811,808 | 5/1974 | Platt | 425/352 |
| 4,063,866 | 12/1977 | Lurbiecki | 425/424 |

*Primary Examiner*—John Parrish
*Attorney, Agent, or Firm*—Blanchard, Flynn, Thiel, Boutell & Tanis

[57] ABSTRACT

A method and apparatus for molding concrete block products is disclosed, in which a surface layer and a back layer are formed by supplying different concrete aggregates into a molding box, pressure and vibration are applied to the concrete aggregates in the molding box to mold a concrete block, the molding box is then turned upside-down for curing and the concrete block is ejected from a lower portion of the inverted molding box.

10 Claims, 10 Drawing Figures

METHOD AND APPARATUS FOR MOLDING CONCRETE BLOCK PRODUCTS

BACKGROUND OF THE INVENTION

The present invention relates to a concrete block molding method and an apparatus for producing multi-layer type concrete blocks.

In concrete blocks or concrete products similar to concrete blocks, it is sometimes desired that the surface be smooth, strong, water-repellent and waterproof. In order to comply with such a desire, the density of the surface layer of the concrete product has to be increased and accordingly the water-cement ratio in the surface layer has to be increased. However, increasing the water-cement ratio is not suitable for a speedy ejection of concrete blocks from a molding box. Furthermore, in order to comply with the above-mentioned desire, the mixing ratio of cement in the concrete product has to be increased. This makes the production cost of the concrete blocks high. In order to overcome such problems, a method of producing concrete blocks comprising a surface layer and a back layer whose components are respectively different is proposed.

To be more specific, in the conventional concrete block products made by the above-mentioned method, the mixing ratio of cement and the water-cement ratio in the surface layer of the concrete block products are high, but in the back layer, a sufficient amount of aggregates is employed and the water-cement ratio is low. In other words, the slump of the concrete mix for use in the surface layer of the concrete block products is about 20 cm, while the slump of the concrete mix for use in the back layer is nearly zero. When a conventional concrete block product is molded, usually the concrete block is pressed and cured with the surface layer thereof down on a pallet. In this case, an excessive amount of water contained in the back layer penetrates the surface layer and comes out of the surface layer. The water from the back layer which stays on the pallet is so basic that it forms white patterns on the surface of the concrete block product. This is one of the disadvantages of the conventional method of producing concrete blocks.

Furthermore, when supplying two types of concrete mixes with different mixing ratios of the ingredients into a molding box, as the first layer, a soft kneaded concrete mix is first supplied to the molding box by a concrete mix supply means and after the first layer is supplied uniformly, a hard kneaded concrete mix for forming a back layer of the concrete block product is supplied. In this case, the thickness of the surface layer is apt to be made uneven and occasionally the back layer appears through the thin portions of the surface layer. In order to prevent this, the surface layer has to be made thick enough although comparatively expensive materials, such as ornamental pebbles, white cement, and pigments, are employed in the surface layer. This is another disadvantage of the conventional method of producing concrete blocks.

SUMMARY OF THE INVENTION

It is therefore a primary object of the present invention to provide a method and apparatus of producing concrete block products having a beautiful surface and a high surface density with a water-repellent property by use of concrete mixes with a low water-cement ratio.

According to the present invention, a concrete mix for forming a surface layer of a concrete block product is supplied to a molding box from a feed box and the supplied concrete mix is packed uniformly in the molding box by a bottom portion of the feed box. Therefore, the thickness of the surface layer is always kept uniform. After a back layer is formed on the surface layer and the concrete block is molded, the molding box is turned upside down, so that the concrete block is cured with the surface layer up. Therefore, any excess water in the surface layer goes into the back layer, so that such white patterns as are formed in the conventional concrete block products are not formed.

The present invention can be applied to the production of concrete blocks made of two different types of components, such as terrazzo-finish concrete blocks, colored flat concrete blocks and blocks for use in sidewalks, to the production of concrete blocks with specially smooth surfaces and to the production of concrete blocks which cannot be produced without inverting the molding box, such as concrete blocks with concave and convex patterns and openwork concrete blocks.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF THE PREFERRED EMBODIMENT

Figure 1:
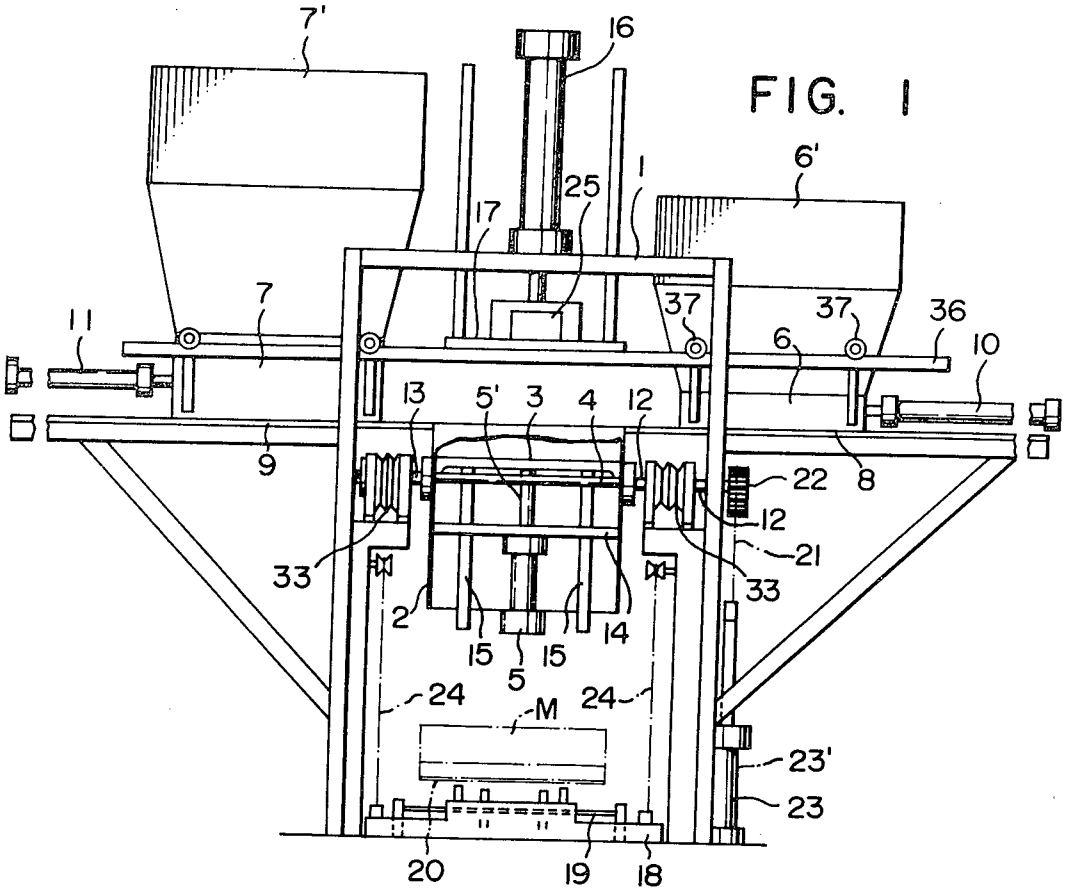
FIG. 1 is a partially cutaway front view of a concrete block molding apparatus according to the present invention.
Figure 2:
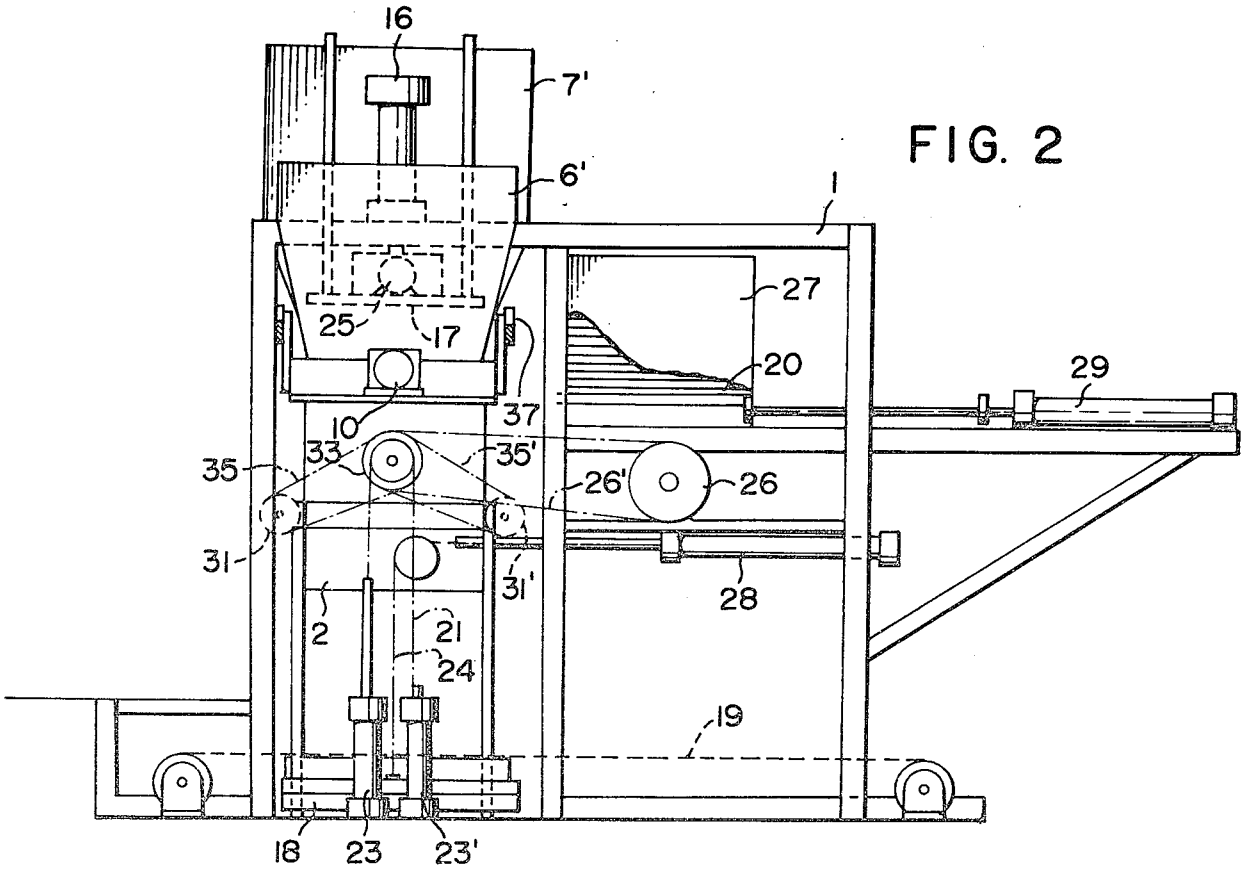
FIG. 2 is a partially cutaway side view of the concrete block molding apparatus of FIG. 1.

Referring to FIG. 1, there is shown a partially cutaway front view of an embodiment of a concrete block molding apparatus according to the present invention. FIG. 2 is a partially cutaway side view of the concrete block molding apparatus of FIG. 1. In FIG. 1, reference numeral 1 identifies the frame of the concrete block molding apparatus. On opposite sides of the frame 1, there are disposed a first feed box 6 for holding a concrete mix therein, which can be slidably moved on a table plate 8 by a cylinder 10, and a second feed box 7 for holding a second mix concrete therein, which can be likewise slidably moved on a table plate 9 by a cylinder 11. The table plates 8 and 9 serve as the bottom plates of the feed boxes 6 and 7, respectively. Above the feed box 6 and the feed box 7, there are respectively situated hoppers 6' and 7' for supplying concrete mixes therefrom into the feed box 6 and the feed box 7. In the central portion of the frame 1, there is disposed a molding box 2 whose upper edge is at the same level as that of the table plates 8 and 9. As the feed box 6 is slidably brought into the central portion of the frame 1 along the table plate 8 by the action of the cylinder 10, the concrete mix in the feed box 6 is supplied into the molding box 2 from the open upper end of the feed box 6. This applies to the feed box 7. The molding box 2 is rotatably supported on shafts 12 and 13 which are respectively supported by the side plates of the frame 1. The molding box 2 can be rotated through an arc of 180° by inverting cylinders 23 and 23' which are connected to the shafts 12 and 13 by a chain 21. The feed boxes 6 and 7 are guided along a rail 36 by wheels 37.

In the molding box 2, an elevatable bottom plate 3 for forming the top surface of each concrete block product is placed on a fixed plate 4, and under the fixed plate 4, there is disposed a cylinder 5 which is supported by a support member 14. The top portion of a piston rod 5' of the cylinder 5 is secured to the lower surface of the elevatable bottom plate 3, whereby the elevatable plate 3 can be moved up and down. Guide rods 15 pass through the fixed plate 4 and the support member 14.

Referring to FIG. 2, the molding box 2 is provided with vibration means for applying vibration to the molding box 2 during the molding process with pressure.

Reference numeral 26 represents a motor for the vibration means.

Referring back to FIG. 1, above the molding box 2, there is disposed a press cylinder 16 which is fixed to an upper portion of the frame 1. A press plate 17 is attached to the top portion of a piston rod of the press cylinder 16. By the press plate 17, pressure is applied to the concrete mixes in the molding box 2 during the molding process.

Under the molding box 2, there are disposed a table frame 18 for receiving a concrete block product M thereon, which frame can be moved up and down by chains 24 when the concrete block product M is ejected from the molding box 2 after the molding box 2 is inverted by the reversing cylinders 23 and 23', and a chain apparatus 19 for carrying the concrete block product M thereon out of the concrete molding apparatus when the table frame 18 comes down to a predetermined position.

In FIG. 2, reference numeral 27 represents a pile of pallets 20 which are individually carried onto the molding box 2 by a pallet feed cylinder 29.

Figure 8:
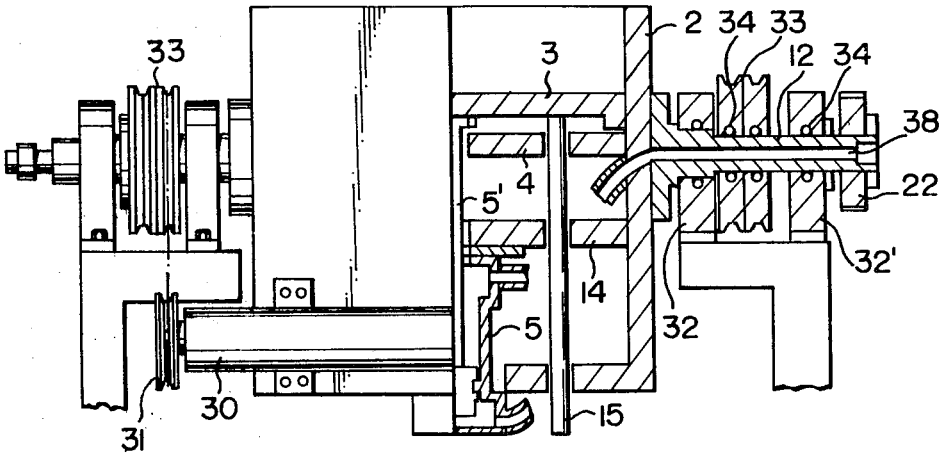
FIG. 8 is a partially cutaway view of the molding box for use in the concrete block molding apparatus of FIG. 1.
Figure 9:
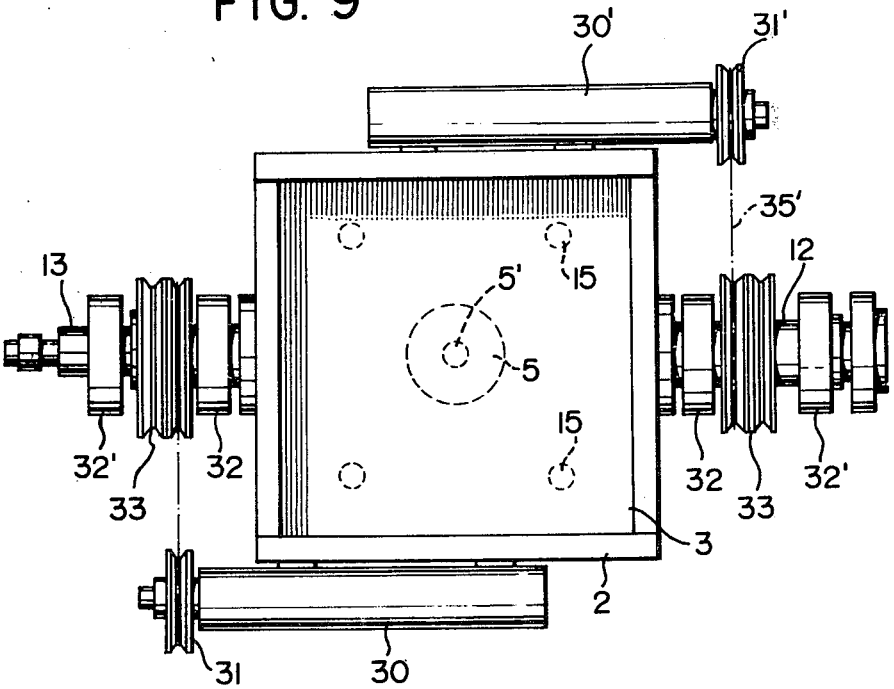
FIG. 9 is a plan view of FIG. 8.

A belt 26' is trained over or around one double pulley 33 and the motor 26, and a belt 35' is trained over or around the double pulley 33 and a pulley 31' of a vibration shaft 30' and a belt 35 is trained over or around the other double pulley 33 and a pulley 31 of a vibration shaft 30, so that by rotating the vibration shafts 30 and 30', which are attached to the molding box 2, the molding box 2 is vibrated (refer to FIG. 8 and FIG. 9).

Figure 3:
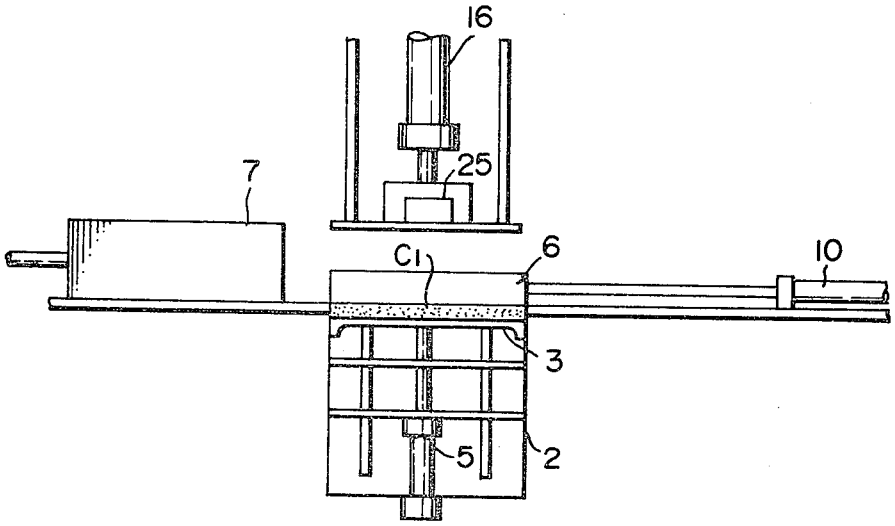
FIG. 3 is a schematic side view of the feed boxes and a molding box of the concrete block molding apparatus of FIG. 1 during the first step of feeding a concrete mix.

The operation of the concrete block molding apparatus will be now explained. Referring to FIG. 3, there is partly shown the concrete block molding apparatus during the step of feeding the first concrete mix. In the first feeding step, the elevatable bottom plate 3 is moved upwardly to a predetermined position by the piston rod 5' of the cylinder 5 in the molding box 2, so that a first space for forming a surface layer of a concrete block product is provided in the upper portion of the molding box 2. The feed box 6 is moved so as to cover the first space by operation of the piston rod of the cylinder 10 and a first layer $C_1$ of concrete mix for forming the surface layer of the concrete block product is fed into the first space.

Figure 4:
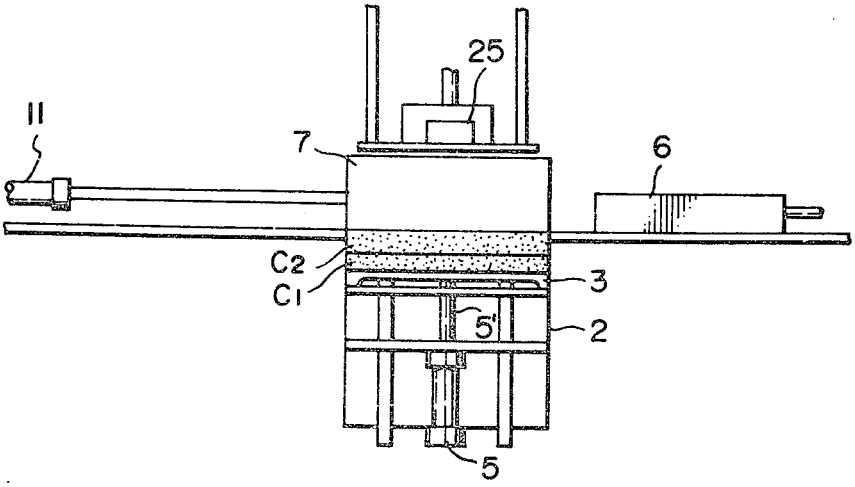
FIG. 4 is a schematic side view of the feed boxes and the molding box of the concrete block molding apparatus of FIG. 1 during the second step of feeding concrete aggregates.

Referring to FIG. 4, there is partly shown the concrete block molding apparatus during the step of feeding the second concrete mix. In the second feeding step, the piston rod 5' of the cylinder 5 of the molding box 2 is lowered and the elevatable bottom plate 3 with the first concrete mix layer $C_1$ thereon is lowered to the fixed plate 4, so that a second space is provided in the upper portion of the molding box 2. In the meanwhile, the feed box 6 is retracted to its original position and instead the feed box 7 is advanced so as to cover the second space and a second layer $C_2$ of concrete mix is fed into the second space. The molding box 2 has been vibrated by the vibration means with the start of feeding the concrete mixes into the molding box 2 as will be described in detail.

Figure 5:
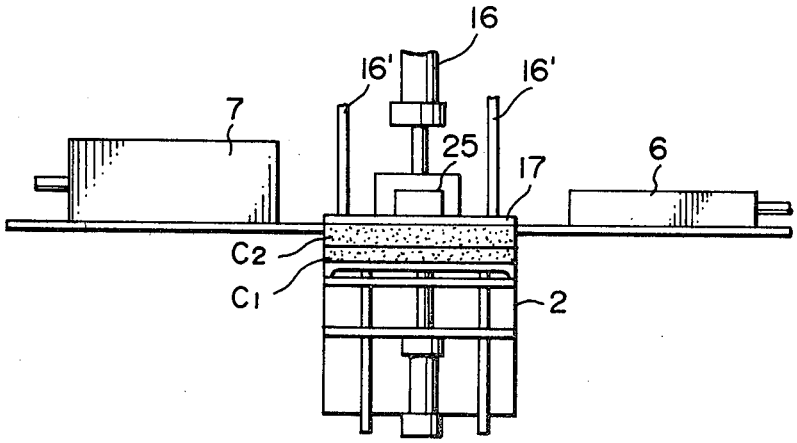
FIG. 5 is a schematic side view of the feed boxes and the molding box of the concrete block molding apparatus of FIG. 1 during the molding process.

Referring to FIG. 5, there is partly shown the concrete block molding apparatus during the molding process with pressure application. When the feeding of the second layer of concrete mix by the feed box 7 is completed, the feed box 7 is retracted to its original position and the press plate 17 is lowered by the piston rod of the press cylinder 16 and applies pressure to the concrete mix layers $C_1$ and $C_2$ in the molding box 2, with application of vibration to the molding box 2 by a motor 25 for applying vibration, so that the concrete mix layers $C_1$ and $C_2$ can be molded into a homegeneous and high density concrete block. In this case, guide rods 16' serve to guide the press plate 17 so as to apply pressure to the concrete mix layers $C_1$ and $C_2$ uniformly.

Figure 6:
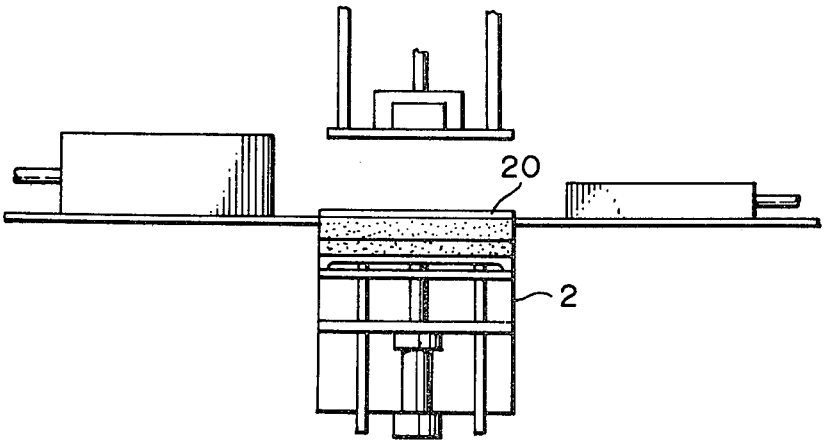
FIG. 6 is a schematic side view of the feed boxes and the molding box of the concrete block molding apparatus of FIG. 1 when the feed boxes are retracted and a pallet is placed onto the molding box.

Referring to FIG. 6, there is partly shown the concrete block molding apparatus when the pallet 20 for placing the concrete block product thereon is fed onto the molding box 2 after the molding process with the application of pressure and vibrations has been completed. As can be seen from FIG. 2, the pallets 20, which are stocked behind the concrete block molding apparatus, are individually placed onto the molding box 2 from the pile of the pallets 20 by the pallet feed cylinder 29.

Figure 7:
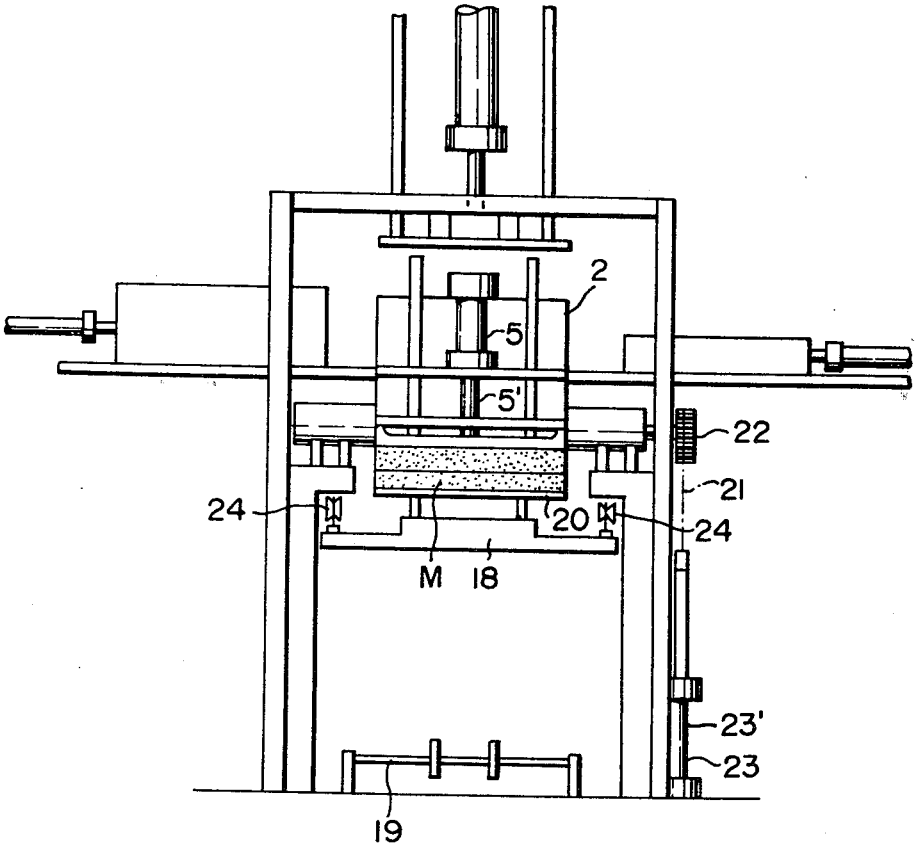
FIG. 7 is a schematic front view of the concrete block molding apparatus of FIG. 1 during the concrete block ejection step.

Referring to FIG. 7, there is shown schematically the concrete block molding apparatus during the concrete block ejection process in which the molding box 2 is inverted. When the pallet 20 is brought into close contact with the top portion of the molding box 2, an inverting gear 22 is rotated by the inverting cylinders 23 and 23' through the chain 21, so that the molding box 2 is rotated through an arc of 180° and at the same time, the table frame 18 is elevated by the chains 24 through the action of a cylinder 28 (refer to FIG. 2) so as to support the lower surface of the inverted molding box 2. The concrete block product M is ejected from the molding box 2 by the piston rod 5' of the cylinder 5 while applying vibrations to the molding box 2. As the concrete block product M is ejected, the table frame 18 is lowered to a lowermost position. The pallet 20 is placed on the chain apparatus 19 and is then carried out of the concrete block molding apparatus.

Referring to FIG. 8 and FIG. 9, there are shown the supporting mechanism of the molding box 2 and the vibration application mechanism for the molding box 2. FIG. 8 is a partially cutaway view of the supporting mechanism of the molding box 2 and FIG. 9 is a plan view of FIG. 8. The shaft 12 which is rotated by the inverting gear 22 is rotatably supported by bearing means 32 and 32' having ball bearings 34, respectively, and inside the shaft 12, there is disposed an oil circuit 38 for use with the cylinder 5. Between the bearing means 32 and 32', there are mounted the double pulleys 33. As mentioned previously, the belt 26' is trained over or around one double pulley 33 and the motor 26, the belt 35' is trained over or around the double pulley 33 and the pully 31', and the belt 35 is trained over or around the other double pulley 33 and the pulley 31. The pulleys 31 and 31' serve to rotate the vibration shafts 30 and 30' attached to the front and back sides of the molding box 2 for vibrating the molding box 2. The double pulleys 33 are rotatably mounted on the shafts 12 and 13 through the bearings 34. Therefore, the double pulleys 33 can be rotated independently of the shafts 12 and 13.

Figure 10:
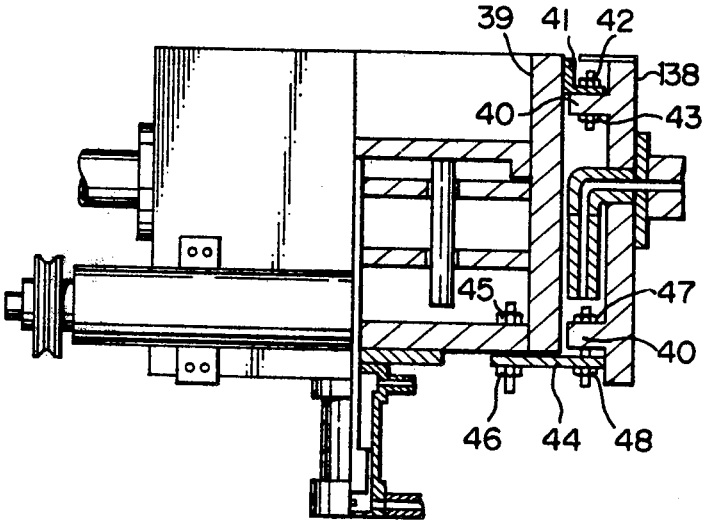
FIG. 10 is a partially cutaway view of another molding box for use in the concrete block molding apparatus of FIG. 1.

In the case where the molding box 2 is detachably mounted on the frame 1, various types of concrete block products can be made by replacing the molding box 2 with a desired type molding box. FIG. 10 shows a partially cutaway view of such detachable molding box. The molding box comprises an outer frame 138 and a box 39 of a desired shape. The box 39 is detachably attached to the outer frame 138, with an upper projection 41 of the box 39 fixed to an upper projection 40 of the outer frame 138 by bolts and nuts 42 and 43 and with a lower portion of the box 39 fixed to another projection 40 of the outer frame 138 by a connecting plate 44 and bolts and nuts 45, 46, 47 and 48. Thus, by replacing the molding box with a desired molding box, concrete blocks of a desired shape can be made in the same concrete molding apparatus.

What is claimed is:

1. A concrete block molding apparatus comprising: an upright frame; an upright molding box defining a vertical mold cavity for molding a concrete block, said mold cavity being open at one vertical end thereof; means rotatably mounting said molding box on said frame for rotation about a horizontal axis and means for rotating said molding box about said horizontal axis through an arc of about 180° between a first position in which said one vertical end of said mold cavity opens upwardly and a second position in which said one vertical end of said mold cavity opens downwardly; a vertically reciprocable bottom plate disposed within said molding box, means for moving said bottom plate vertically relative to and within said molding box toward and away from said open end of said mold cavity between a plurality of vertically spaced positions in said mold cavity, said bottom plate being rotatable about said horizontal axis with said molding box, said bottom plate defining the bottom wall of said mold cavity in said first position of said molding box, said bottom plate defining the upper wall of said mold cavity in said second position of said molding box; a plurality of movable feed boxes alternately movable above the upper end of said mold cavity in said molding box when said molding box is in said first position for feeding concrete mixes into said mold cavity; and press plate means movably supported on said frame above the upper end of said molding box for pressing downwardly on the upper surface of a charge of concrete mix in said mold cavity in said molding box when said molding box is in said first position in order to mold said charge, whereby a concrete block can be molded when said molding box is in said first position and then said molding box can be inverted so that the concrete block can be ejected downwardly from said mold cavity by moving said bottom plate downwardly in said mold cavity.

2. A concrete block molding apparatus as claimed in claim 1 wherein said means for moving said bottom plate vertically relative to and within said molding box comprises a vertical, fluid pressure operated cylinder affixed to said molding box and having a vertically reciprocable piston rod slidably disposed therein, said cylinder and said piston rod being disposed on the opposite side of said bottom plate from said mold cavity, said piston rod being connected to said bottom plate so that said bottom plate can be moved between said vertically spaced positions in said mold cavity by supplying pressurized fluid to said cylinder.

3. A concrete block molding apparatus comprising:

an upright frame;

an upright molding box defining a vertical mold cavity for molding a concrete block, said mold cavity being open at one vertical end thereof;

means rotatably mounting said molding box on said frame for rotation about a horizontal axis, said means rotatably mounting said molding box on said frame comprising horizontal rotatable shaft means affixed to said molding box between the opposite vertical ends thereof, the axis of said shaft means passing transversely through said molding box, and bearing means mounted on said frame and supporting said shaft means for rotation;

means for rotating said molding box about said horizontal axis through an arc of about 180° between a first position in which said one vertical end of said mold cavity opens upwardly and a second position in which said vertical end of said mold cavity opens downwardly;

a vertically reciprocable substantially horizontal bottom plate disposed within said molding box and facing toward said open one vertical end of said molding box;

means for moving said bottom plate vertically relative to and within said molding box toward and away from said open end of said mold cavity between a plurality of vertically spaced positions in said mold cavity, said bottom plate being rotatable about said horizontal axis with said molding box, said bottom plate defining the bottom wall of said mold cavity in said first position of said molding box, said bottom plate defining the upper wall of said molding cavity in said second position of said molding box;

a plurality of movable feed boxes alternately movable above the upper end of said mold cavity in said molding box when said molding box is in said first position for feeding concrete mixes into said mold cavity; and press plate means movably supported on said frame above the upper end of said molding box for pressing downwardly on the upper surface of said charge of concrete mix in said mold cavity in said molding box when said molding box is in said first position in order to mold said charge, whereby a concrete block can be molded when said molding box is in said first position and then said molding box can be inverted so that the concrete block can be ejected downwardly from said mold cavity by moving said bottom plate downwardly in said mold cavity.

4. A concrete block molding apparatus as claimed in claim 1, including a vertically movable, horizontal table mounted on said frame below said molding box and in vertical alignment therewith, and means for moving said table between a first vertically upward position located adjacent to and below the lower end of said molding box when said molding box is in said second position for receiving a concrete block ejected from said mold cavity and a second vertically downward position spaced downwardly from the lower end of said molding box.

5. A concrete block molding apparatus as claimed in claim 1 or claim 4 including a pair of horizontal table plates mounted on said frame and extending in opposite lateral directions from the opposite sides of said molding box, said table plates being substantially coplanar with the upper edge of said molding box in said first position of said molding box, said feed boxes comprising a pair of reciprocable feed boxes each of which is horizontally slidable on the upper surface of one of said table plates.

6. A concrete block molding apparatus as claimed in claim 1 including a pallet feeder for feeding a pallet onto the upper side of a concrete block in said mold cavity when said molding box is in said first position.

7. A concrete block molding apparatus as claimed in claim 5 including a pallet feed cylinder mounted on said frame at a position laterally offset from said molding box and on about the same vertical level as the upper edge of said molding box in said first position of said molding box for feeding a pallet onto the upper side of a concrete block in said mold cavity when said molding box is in said first position.

8. A concrete block molding apparatus as claimed in claim 1 in which said press plate means comprises a vertically reciprocable press plate supported on said frame directly above and in vertical alignment with said molding box.

9. A concrete block molding apparatus as claimed in claim 3 wherein said molding box is detachably mounted on said shaft means.

10. In a concrete block molding apparatus in which a surface layer, providing the exposed face of the finished block, and a back layer are formed by supplying successive different concrete mixes to a molding box:

an upright frame;

an upright molding box defining a vertical mold cavity for molding a concrete block, said mold cavity being open at one vertical end thereof;

means rotatably mounting said molding box on said frame for rotation about a horizontal axis from a first position in which said one vertical end of said mold cavity opens upward;

press plate means movably supported on said frame above the upper end of said molding box for pressing downwardly on the upper surface of a charge of concrete mix in said mold cavity in said molding box with said molding box in said first position in order to mold said charge;

the improvement wherein excessive water in the surface layer is caused to drain toward the back layer after molding to avoid formation of white patterns in said exposed face of said surface layer of said block, and including a substantially horizontal bottom plate vertically reciprocable within said molding box and facing toward said open one vertical end of said molding box, said bottom plate being vertically movable relative to and within said molding box toward and away from said open end of said mold cavity between a plurality of vertically spaced positions in said mold cavity, said bottom plate being rotatable about said horizontal axis with said molding box, said bottom plate defining a bottom wall of said mold cavity in said first position of said molding box;

a plurality of movable feed boxes alternately movable above the upper end of said mold cavity in said molding box with said molding box in said first position for feeding successive concrete mixes into said mold cavity and thereby forming a plurality of successive layers of said concrete charge in said mold cavity, including a surface layer and a back layer above said surface layer, said bottom plate in said first position of said mold cavity being movable away from said open end through said vertically spaced positions to successively make room for said layers of concrete mix fed into said molding cavity from said feed boxes, the plane of rotation of said molding box being transverse to the path of movement of said feed boxes;

means for applying a pallet to said open upper end of said molding box below said press plate and atop the last of said charge of concrete;

means for rotating said molding box about said horizontal axis through an arc of about 180° from said first position to a second position in which said one vertical end of said mold cavity opens downwardly, said bottom plate defining the upper wall of said molding cavity in said second position of said molding box;

means actuable in said second position of said molding box to advance said bottom plate toward said open end for ejecting the molded concrete block downwardly from said mold cavity, such that said surface layer faces upward away from said back layer in said second position for curing and any excess water in said surface layer can drain downward toward said back layer to avoid formation of white patterns in the exposed face of said surface layer.

* * * * *

UNITED STATES PATENT AND TRADEMARK OFFICE

CERTIFICATE OF CORRECTION

PATENT NO. : 4 265 609

DATED : May 5, 1981

INVENTOR(S) : Yutaka Kitahara

It is certified that error appears in the above—identified patent and that said Letters Patent is hereby corrected as shown below:

Column 6, line 11; change "claim 1" to ---claim 3---.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*